US009174087B2

(12) United States Patent
Watchorn

(10) Patent No.: US 9,174,087 B2
(45) Date of Patent: Nov. 3, 2015

(54) SWIMMING HAND PADDLE

(71) Applicant: Sara F Watchorn, Salt Lake City, UT (US)

(72) Inventor: Sara F Watchorn, Salt Lake City, UT (US)

( * ) Notice: Subject to any disclaimer, the term of this patent is extended or adjusted under 35 U.S.C. 154(b) by 117 days.

(21) Appl. No.: 13/970,758

(22) Filed: Aug. 20, 2013

(65) Prior Publication Data

US 2015/0056878 A1 Feb. 26, 2015

(51) Int. Cl.
*A63B 31/10* (2006.01)
*A63B 31/08* (2006.01)

(52) U.S. Cl.
CPC ..... *A63B 31/10* (2013.01)

(58) Field of Classification Search
CPC ..... A63B 31/10; A63B 31/08
USPC ..... 441/56, 58
See application file for complete search history.

(56) References Cited

U.S. PATENT DOCUMENTS

| | | | | | |
|---|---|---|---|---|---|
| 1,395,914 | A | * | 11/1921 | Grundmann | 441/58 |
| 1,754,704 | A | * | 4/1930 | Wilcox | 441/58 |
| 2,810,138 | A | * | 10/1957 | Cochran | 441/58 |
| 3,146,470 | A | * | 9/1964 | Hamblin | 441/58 |
| 3,328,812 | A | * | 7/1967 | Berthiot | 441/58 |
| 4,509,744 | A | * | 4/1985 | Beasley | 482/111 |
| 4,913,418 | A | | 4/1990 | Schlueter et al. | |
| 5,288,254 | A | * | 2/1994 | Elson | 441/56 |
| 5,304,080 | A | * | 4/1994 | Dilger | 441/58 |
| 5,643,027 | A | * | 7/1997 | Evans et al. | 441/58 |
| 5,842,896 | A | * | 12/1998 | Liveoak | 441/56 |
| 7,044,819 | B1 | * | 5/2006 | Dulemba | 441/58 |
| 7,179,146 | B2 | * | 2/2007 | Johnson | 441/56 |
| 2004/0203301 | A1 | * | 10/2004 | Johnson | 441/56 |
| 2008/0032573 | A1 | * | 2/2008 | Krikliwy et al. | 441/56 |
| 2015/0056878 | A1 | * | 2/2015 | Watchorn | 441/58 |

FOREIGN PATENT DOCUMENTS

EP 0844901 10/2000

OTHER PUBLICATIONS http://www.swimoutlet.com/blog/top-swim-paddles-compared-the-gangloff-review, Dated Blog Entry.

* cited by examiner

*Primary Examiner* — S. Joseph Morano
*Assistant Examiner* — Jovon Hayes
(74) *Attorney, Agent, or Firm* — Trent Baker; Baker & Associates PLLC

(57) ABSTRACT

One embodiment of the present invention relates to a hand paddle system comprising a wrist member and a hand member. The wrist member and hand member are intercoupled. The wrist and hand members are configured to releasably couple or receive the scaphoid and metacarpal regions of a user's hand. The hand paddle system is composed and/or configured to be buoyant. The hand paddle system may also include a finger member coupled to the hand member opposite of the wrist member. The system causes an increased water entry resistance when the user improperly orients their arm and/or wrist leading up to and at the catch point and the buoyancy facilitates an early, high elbow catch and pull.

19 Claims, 5 Drawing Sheets

SWIMMING HAND PADDLE

FIELD OF THE INVENTION

The invention generally relates to generally relate swimming hand paddles. In particular, the present invention relates to an improved hand paddle for swimming instruction and training.

BACKGROUND OF THE INVENTION

Hand paddles are routinely used for training both the neurological and physical patterns of swimming. Conventional hand paddles are generally substantially two dimensional planar members configured to attach to the palmar surface of a user's hand. The attachment between the hand paddle and the user's hand is intended to be maintained during a particular swim training or learning session. The user performs swimming strokes with the aid of the hand paddle. The planar nature of the hand paddle provides a larger and more consistent water surface area compared to a user's naked hand, thereby allowing the swimmer to increase propulsion during the stroke. Various conventional planar shapes convey differing properties relating to the stroke including increased water resistance during the pulling phase, decreased water resistance during the extension phase, etc.

Unfortunately, conventional hand paddles generally fail to incorporate educational feedback to the user with respect to optimal stroke performance which may then be translated to unassisted swimming. For example, a hand paddle may encourage inefficient stroke mechanics. Likewise, certain hand paddle coupling systems may encourage a user to maintain inefficient finger alignment during unassisted swimming. Further, conventional hand paddles may sink when decoupled from a user. A submerged hand paddle may create a hazard if decoupled and then contacted by another swimmer. Likewise, a submerged hand paddle may be lost in an open water session or may otherwise result in inefficient usage of pool time. In addition, the substantially planar shape of conventional hand paddles may include a sharp edge hazard if a novice swimmer accidently contacts another swimmer during a training session.

Therefore, there is a need in the industry for an improved hand paddle that overcomes the limitations of conventional hand paddles.

SUMMARY OF THE INVENTION

The present invention relates to swimming hand paddles. One embodiment of the present invention relates to a hand paddle system comprising a wrist member and a hand member. The wrist member and hand member are intercoupled. The wrist and hand members are configured to releasably couple or receive the scaphoid and metacarpal regions of a user's hand. The hand paddle system is composed and/or configured to be buoyant. The hand paddle system may also include a finger member coupled to the hand member opposite of the wrist member. The system causes an increased water entry resistance when the user improperly orients their arm, hand and/or wrist leading up to and at the catch point. A second embodiment of the present invention relates to a method for encouraging optimal muscular coordination and orientation of a user's hand during a swimming stroke, including providing a hand paddle system with a wrist member and hand member, causing increased water entry resistance if the user places any portion of the wrist member in the water prior to the hand member, and minimizing water entry resistance if the user places the hand member in the water prior to the wrist member.

Embodiments of the present invention represent a significant advance in the field of swimming hand paddles by incorporating direct user feedback to encourage optimal swimming stroke mechanics, which can be translated to unassisted or non-hand paddled swimming technique. The direct user feedback includes a water-hand entry resistance associated with improper or poor swimming technique and a water-hand minimum resistance associated with proper or efficient technique. The technique may include arm, wrist, and/or hand angle leading up to and at the catch point of each stroke. In addition, embodiments of the present invention strengthen muscles associated with efficient unassisted swimming mechanics. For example, a user is encouraged to train muscles that enable proper arm and wrist orientations for optimal stoke efficiency. The user therefore optimizes their unassisted swimming stroke through use of the system 100. The direct physical feedback further promotes optimal distance per stroke and increased strength throughout the range of motion associated with proper swimming technique. Other benefits may include encouraging the user to properly and efficiently track their hands throughout the pull and recovery phases of the stroke. For example, precision and forward tracking during the submersion, a high elbow recovery, and an increased body rotation during the stroke.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
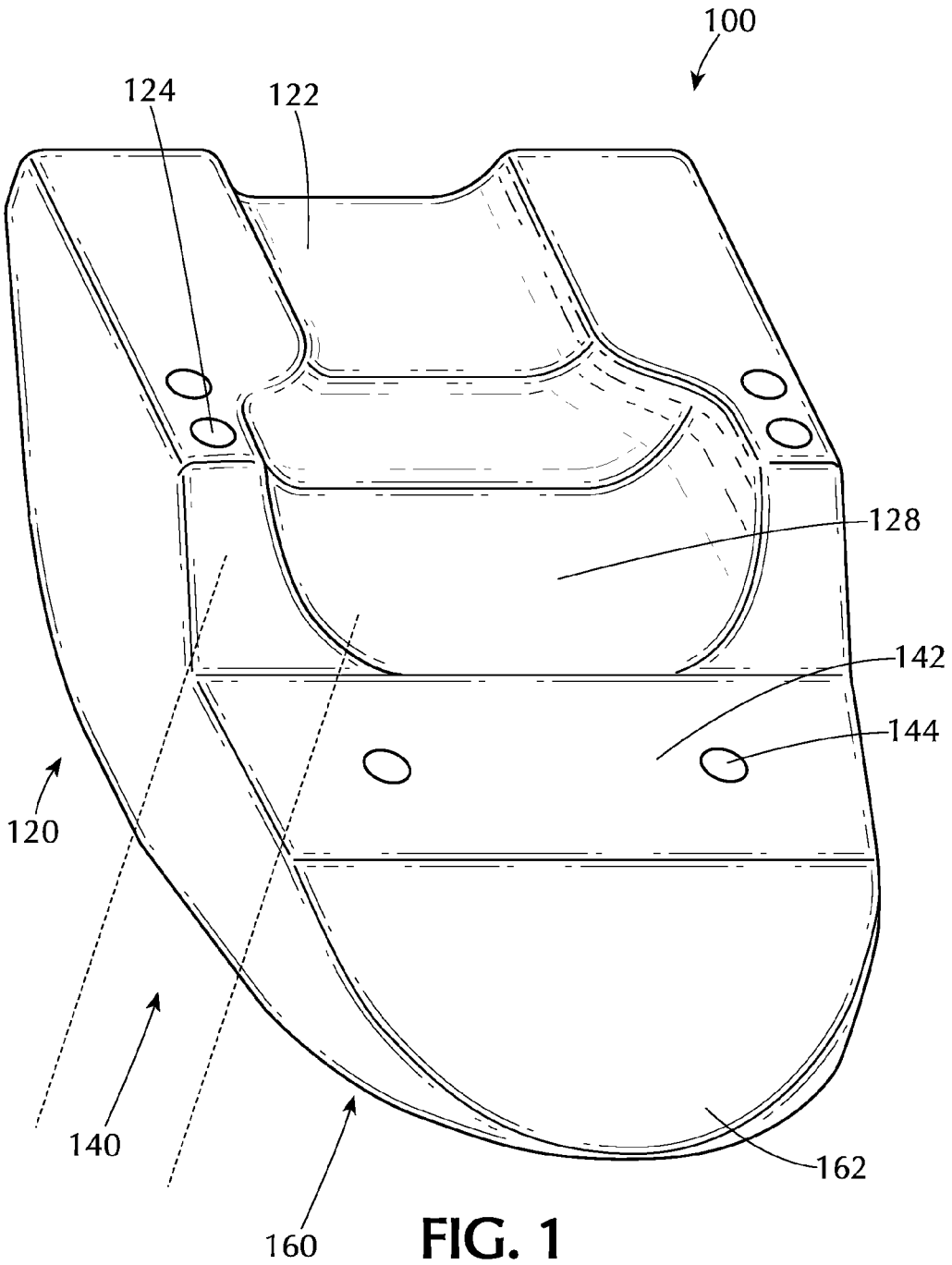
FIG. 1 illustrates a perspective view of a hand paddle system in accordance with one embodiment of the present invention, oriented with the top surface substantially outward and the distal end oriented substantially downward.
Figure 2:
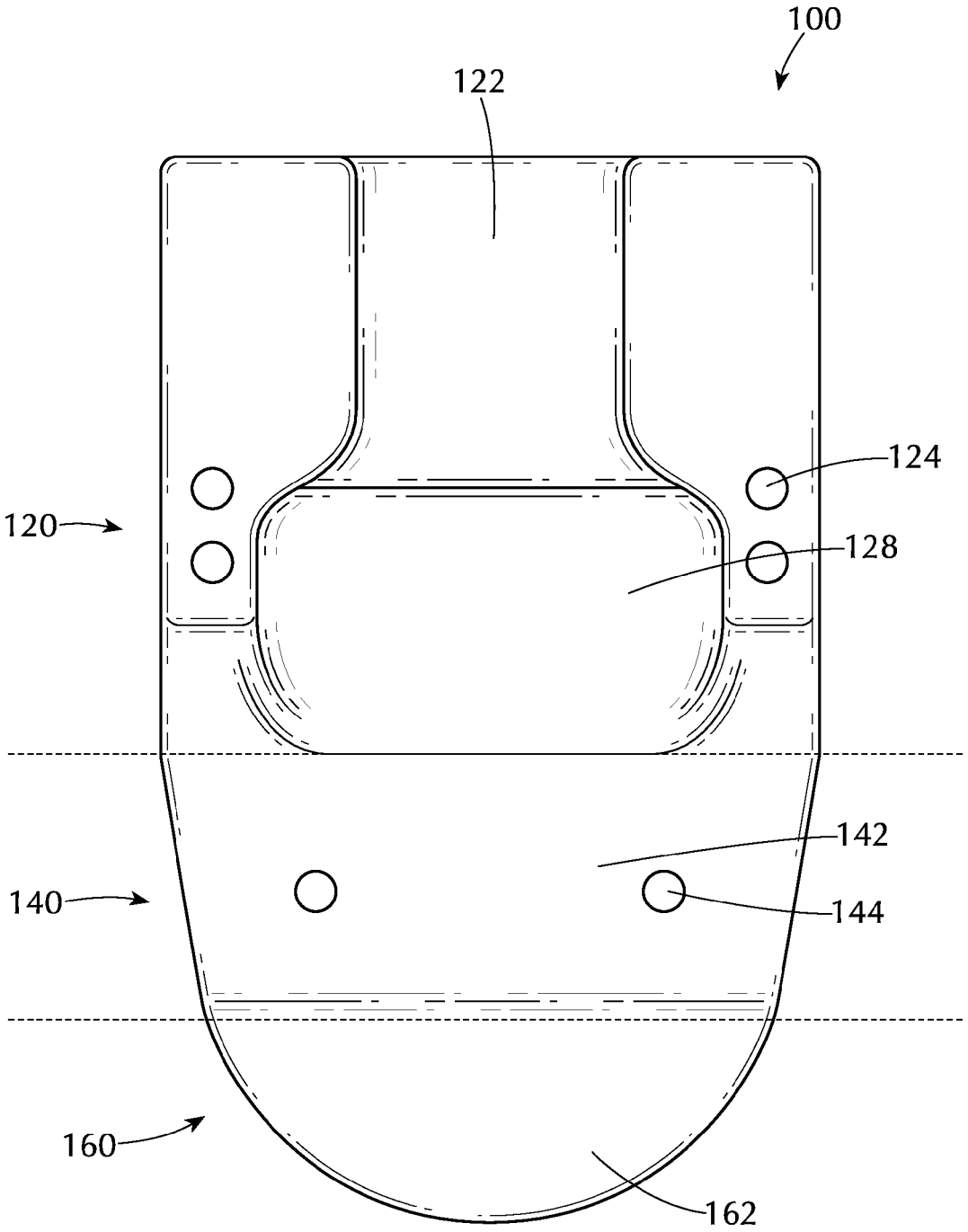
FIG. 2 illustrates a top view of the hand paddle system of FIG. 1.
Figure 3:
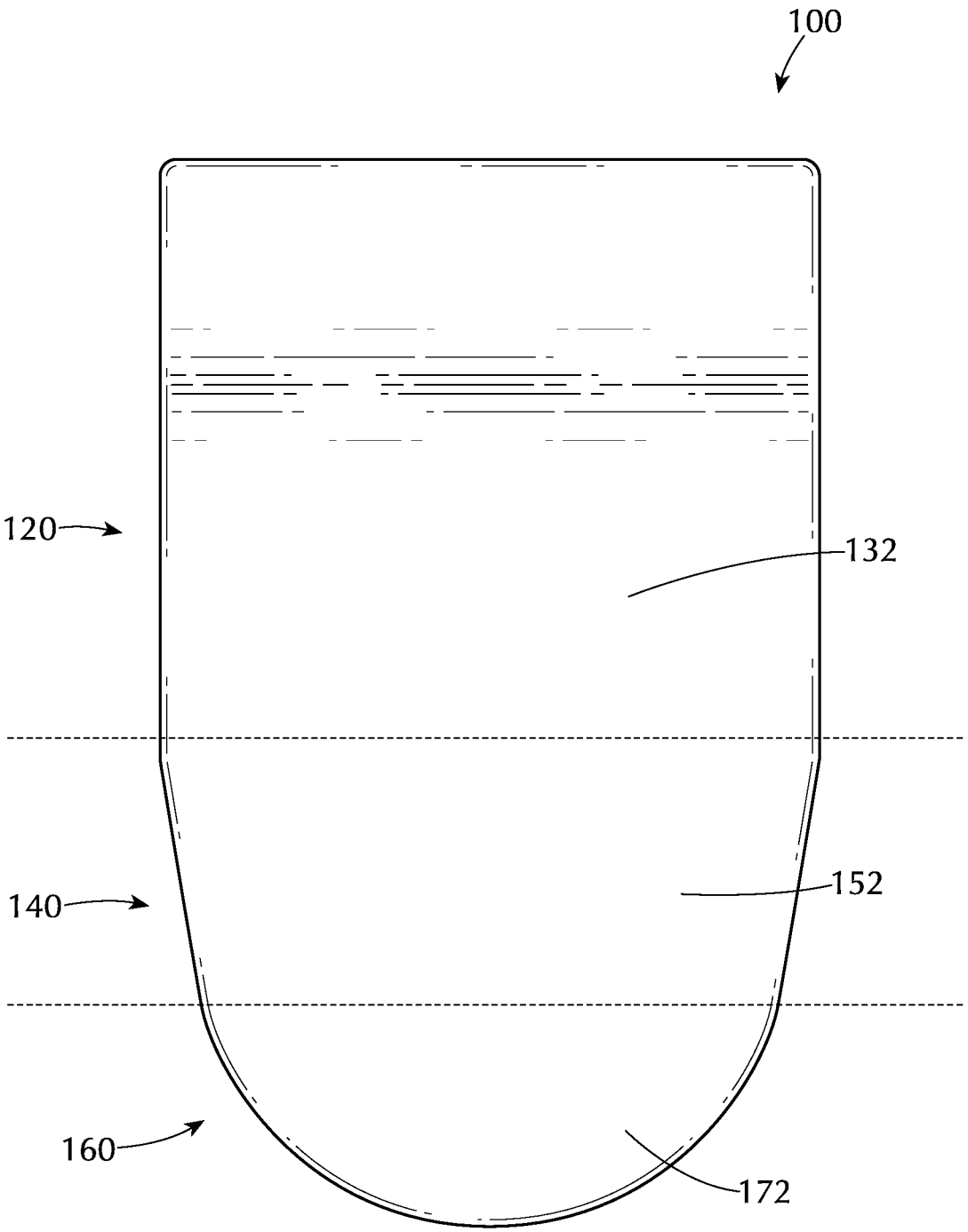
FIG. 3 illustrates a bottom view of the hand paddle system of FIG. 1.
Figure 4:
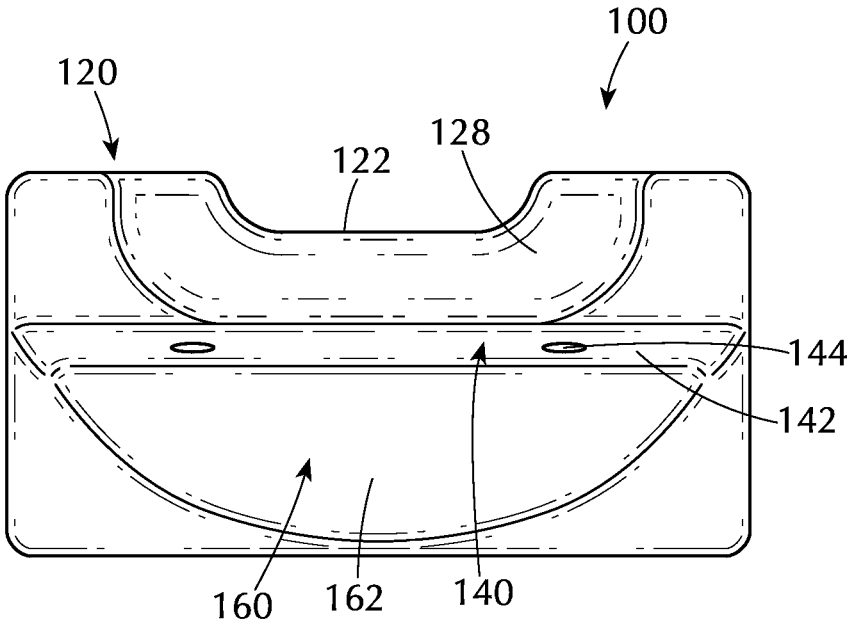
FIG. 4 illustrates a distal view of the hand paddle system of FIG. 1.
Figure 5:
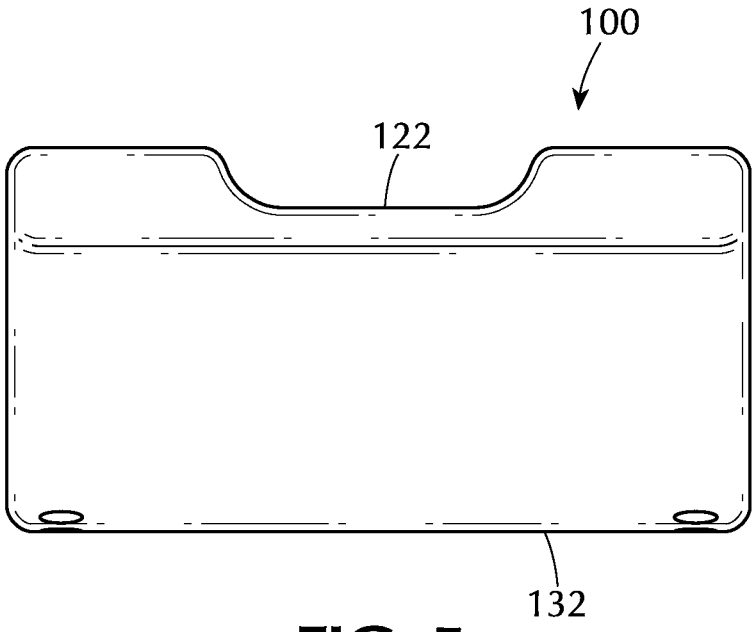
FIG. 5 illustrates a proximal view of the hand paddle system of FIG. 1.
Figure 6:
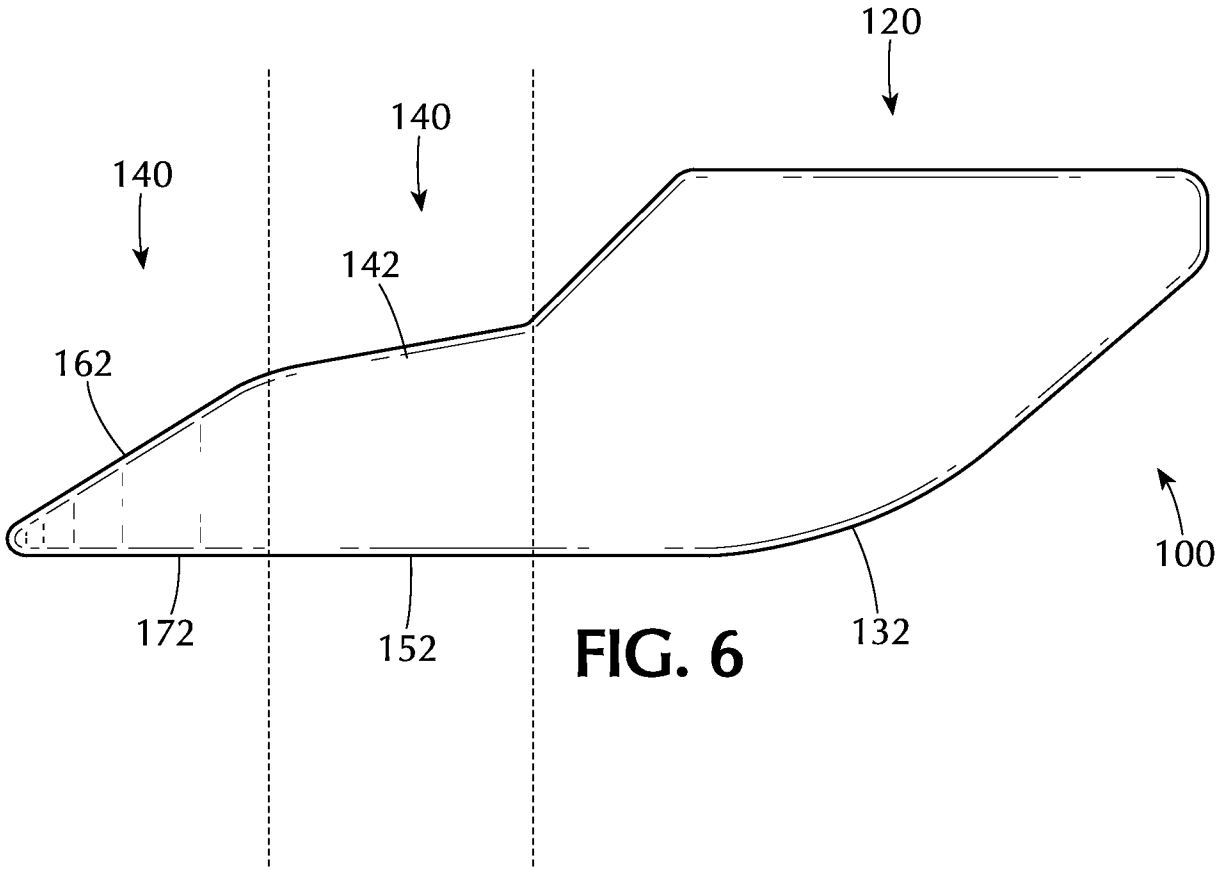
FIG. 6 illustrates a side view of the hand paddle system of FIG. 1 oriented with the distal side facing left.

The present invention relates to swimming hand paddles. One embodiment of the present invention relates to a hand paddle system comprising a wrist member and a hand member. The wrist member and hand member are intercoupled. The wrist and hand members are configured to releasably couple or receive the scaphoid and metacarpal regions of a user's hand. The hand paddle system is composed and/or configured to be buoyant. The hand paddle system may also include a finger member coupled to the hand member opposite of the wrist member. The system causes an increased water entry resistance when the user improperly orients their arm, hand and/or wrist leading up to and at the catch point. A second embodiment of the present invention relates to a method for encouraging optimal muscular coordination and orientation of a user's hand during a swimming stroke, including providing a hand paddle system with a wrist member and hand member, causing increased water entry resistance if the user places any portion of the wrist member in the water prior to the hand member, and minimizing water entry resistance if the user places the hand member in the water prior to the wrist member. Also, while embodiments are described in reference to a swimming hand paddle it will be appreciated that the teachings of the present invention are applicable to other areas including but not limited to other swimming training tools.

The following terms are defined as follows:

DEFINITIONS

Swimming hand paddle—a device configured to be coupled to a user's hand while performing swimming strokes.

Water entry resistance—the amount of resistance experienced by the user upon submersion into the water during a swimming stroke. The water entry resistance may be affected by both buoyancy properties and geometrical surface to water frictional properties. For example, during the performance of a swimming stroke, each hand will sequentially submerge and emerge from the water. The synchronization or sequence of movements between the hands depends on the particular stroke. It will be appreciated that a user's hands may never entirely submerge into or emerge from the water during a stroke. The transition from the substantially emerged state to the substantially submerged state corresponds to the catch or pull of the stroke.

Palmar surface—the palm side of a human hand, opposite of the dorsal or rear side.

Scaphoid region—the wrist region of a human hand corresponding to the scaphoid bone.

Metacarpal region—the hand or palm region of a human hand corresponding to the metacarpal bones.

Phalanges—the finger regions of a human hand corresponding to the distal, middle, and proximal phalange bones.

Catch point—the stroke transition point at which the user's hand partially submerges or enters the water to begin the pulling phase.

Early high elbow catch—optimal stroke mechanics corresponding to a user's arm, wrist, and/or hand angle leading up to and at the catch point.

Unassisted stroke—performing a swimming stroke without a hand paddle.

Reference is made to FIGS. 1-6, which illustrate various view of a hand paddle system in accordance with one embodiment of the present invention, designated generally at 100. The system 100 includes a wrist member 120, a hand member 140, and a finger member 160. It will be appreciated that the finger member 160 is an optional component and an alternative embodiment will be described below that does not contain a finger member. The wrist member 120 includes a top surface (not designated), a bottom surface 132, an arm recess 122, a wrist recess 128, and a set of wrist strap couplers 124. The top surface includes a substantially planar region and a sloped region. The arm recess 122 is a curved recess within the substantially planar portion of the top surface configured to releasably engage a portion of the palmar side of the user's arm proximal of the scaphoid region. The depth of the arm recess 122 is less than the diameter of a user's arm. The arm recess 122 is oriented lengthwise with respect to the top surface to releasably couple a portion of the user's arm proximal of the scaphoid region. The width of the arm recess 122 is greater than the width of the user's arm proximal to the scaphoid region. The wrist recess 128 is a curved recess within the substantially planar portion of the top surface and extends through the sloped region of the top surface. The wrist recess 128 is anatomically aligned with the arm recess 122 and configured to releasable couple the palmar side of the user's metacarpal region. The wrist recess 128 includes a depth greater than the arm recess 122. The width of the wrist recess 128 is greater than the width of the user's scaphoid region. The wrist strap couplers 124 are optionally disposed on the substantially planar portion of the top surface. The wrist strap couplers 124 are configured to permit the attachment of an optional releasable coupler across the dorsal side of the user's scaphoid or wrist region. Various types of couplers or straps may be used in accordance with embodiments of the present invention. The bottom surface 132 of the wrist member includes a substantially planar region, a curved middle region, and a substantially orthogonal region. The substantially planar region of the bottom surface 132 is disposed adjacent to the hand member 140. The substantially orthogonal region of the bottom surface 132 is disposed on an end opposite of the hand member 140. The substantially orthogonal region is oriented substantially orthogonal of the top surface of the wrist member 120. The curved middle region of the bottom surface 132 includes a curvature between 90 and 180 degrees.

The wrist member 120 may include a height or thickness between the top and bottom surfaces. The height between the top and bottom surfaces corresponding to the wrist of the user may be between 1⅝" and 3" depending on the intended user skill and/or water entry resistance. The height corresponds to the degree of buoyancy of the system because a greater total system volume correlates with a greater buoyancy and/or water entry resistance. Therefore, a shorter height may correspond with a beginner or novice embodiment to provide less surface area and/or less water entry resistance if the user improperly angles their arm, wrist, or hand leading up to and at the catch point and less buoyancy making the initiation of an early high elbow catch and pull require less muscular strength. Likewise, a longer height may correspond with an advanced embodiment to provide more water entry resistance if the user improperly angles their arm, wrist, or hand leading up to and at the catch point and more buoyancy making the initiation of an early high elbow catch and pull require more muscular strength. As a novice user becomes more accustomed to the direct feedback provided by the system, the user may benefit from an advanced model that provides greater feedback in the form of increased water entry resistance and increased resistance at the initiation of an early high elbow catch and throughout the pull.

The hand member 140 is coupled to the wrist member and includes a top surface 142, a bottom surface 152, and a set of hand strap couplers 144. The top surface 142 of the hand member 142 is sloped downward away from the wrist member 120 and is configured to receive the palmar side of the user's metacarpal region. The top surface of the hand member 140 includes an area greater than the palmar side of a user's metacarpal region. The illustrated coupling between the wrist member 120 and the hand member 140 includes a discontinuous inflection point between the top surfaces because the sloped region of the top surface of the wrist member 120 has a greater slope than the top surface 142 of the hand member 140. The hand strap couplers 144 are configured to permit the attachment of an optional releasable coupler across the dorsal side of the user's metacarpal or hand region. Various types of couplers or straps may be used in accordance with embodiments of the present invention. The bottom surface 152 of the hand member 140 is substantially planar and continuously coupled to the substantially planar portion of the bottom surface 132 of the wrist member 120. The hand member 140 may also include a height between the top and bottom surfaces corresponding to the amount of water entry resistance if the user improperly angles their arm, wrist, or hand leading up to and at the catch point and the desired amount of resistance created by the buoyancy.

The finger member 160 is coupled to the hand member 140 opposite the wrist member 120. The finger member 160 includes a top surface 162 and a bottom surface 172. The top surface 162 is sloped downward away from the hand member 140 and includes a length greater than the length between the user's distal and proximal phalanges. The top surface 162 includes an area greater than the distal to proximal phalange region of the user's hand. The illustrated coupling between the finger member 160 and the hand member 140 includes a discontinuous inflection point between the top surfaces because the sloped region of the top surface of the finger member 160 has a greater slope than the top surface 142 of the hand member 140. The bottom surface 172 is substantially planar and continuously coupled to the bottom surface 152 of the hand member 140. The top and bottom surfaces 162, 172 of the finger member substantially join to form a narrow tip region opposite the hand member 140.

Reference is next made to a non-illustrated method for encouraging optimal muscular coordination and orientation of a user's hand during a swimming stroke with a provided hand paddle system in accordance with embodiments of the present invention such as the embodiment described above. First, the system is engaging with the palmar surfaces of a user's arm to fingers with portions of the system 100. In particular, the palmar side of the user's arm proximal to the scaphoid region may be engaged within the arm recess 122 of the wrist member 120; the palmar side of the metacarpal region of the user's hand may be engaged within the wrist recess 128; and the palmar side of the user's fingers may be engaged with the top surface 162 of the finger member 160. In alternative embodiments, it will be appreciated that a portion of the user's fingers may wrap around portions of the finger member 160 or hand member 140. An optional releasable coupler may be extended across the dorsal side of the user's scaphoid region between the wrist strap couplers 124. A second optional releasable coupler may also be extended across the dorsal side of the user's metacarpal region between the hand strap couplers 144. Second, the method causes an increased water entry resistance during a stroke if the user places any portion of the wrist member or hand member in the water prior to the finger member. Third, the method causes a minimization of water entry resistance if the user places the finger member in the water prior to the hand member and wrist member. It will be appreciated that if the description above pertains to a system that includes an optional finger member.

In operation, a user performs swimming strokes with the hand paddle system engaged in a manner described above. During a particular stroke, one or both hands partially or completely emerge from and then submerge within the water, representing the transition between strokes. This is generally referred to as the catch point in which the user's hand completely/partially submerges to permit pulling. The system encourages a user to perform an early high elbow catch by causing increased water entry resistance if the user's hand enters the water at an undesirable angle. The angle at which the user's hand enters or submerges translates to the angle at which the wrist, hand, and finger members 120, 140, 160 of the system 100 enter or submerge within the water at the catch point. The bottom surfaces 132, 152, 172 are shaped to increase the water entry resistance if the user improperly drags or extends their hand as it submerges or enters the water. Likewise, the substantially narrow tip region and overall narrow profile of the finger member 160 minimizes water entry resistance if engaged or submerged prior to the hand and wrist members 140, 160. The wrist, hand, and finger members 120, 140, 160 comprise a material that is configured to cause an overall buoyancy of the system 100 with respect to a water surface. Therefore, the minimization of water entry resistance associated with the initial submersion of the narrower finger member 160 overcomes the buoyancy and rewards and/or encourages the user to properly tilt their arm and wrist at the catch point to execute an early high elbow catch that includes properly extending the hand and arm in front of the body leading up to and at the catch point. In contrast, the initial submersion of the hand or wrist members 140, 160 increases water entry resistance through both the blunt geometrical shape of the bottom surfaces and the increased buoyancy effects. The system 100 therefore provides direct physical feedback to teach the user to properly angle their arm and wrist at the catch point.

Reference is next made to various contemplated non-illustrated alternative embodiments of a hand paddle in accordance with the present invention. One alternative embodiment may include similar wrist and hand members without the finger member. A user may then wrap their fingers around the distal end of the hand member. Likewise, the wrist and hand recesses are optional and may be replaced with flat surface while still providing the physical feedback to encourage the user to properly angle their wrist and arm at the catch point.

Embodiments of the hand paddle system are composed of materials to create an overall independent default buoyancy of the system. Therefore, if the system is disengaged from the user, it will float on a water surface. However, in operation, the swimming stroke of a user may easily overcome the buoyancy properties of the system. The members 120, 140, 160 may comprise a foam material having a particular density inversely corresponding to the overall weight of the system.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. A hand paddle system comprising:

a wrist member having a top surface and a bottom surface, and wherein the wrist member is configured to releasably couple with the palmar surface of a user's scaphoid region;

a hand member having a top surface and a bottom surface, and wherein the hand member is coupled to the wrist member and configured to releasably couple with the palmar surface of the user's metacarpal region;

wherein the hand paddle system includes a buoyancy with respect to a water surface;

wherein the bottom surfaces of the wrist member and hand member are configured in combination with the buoyancy to cause an increased water resistance if the wrist member is submerged prior to the hand member or submerged at an improper angle; and wherein the bottom surface of the wrist member includes a curved surface having a curvature between 90 and 180 degrees.

2. The system of claim 1, wherein the releasable coupling of the palmar surface of the user's scaphoid region includes partially encircling the user's scaphoid region within at least one of an arm recess and a wrist recess.

3. The system of claim 1, wherein the wrist member includes a releasable wrist strap coupler configured to encircle the user's metacarpal region in conjunction with at least one of an arm recess and a wrist recess.

4. The system of claim 1, wherein the top surface of the wrist member includes a substantially planar surface.

5. The system of claim 1, wherein the curved surface of the bottom surface of the wrist member includes a substantially planar region at the coupling to the hand member, a substantially orthogonal region coupled to the top surface of the wrist member, and a curved medial region disposed between the substantially planar region and substantially orthogonal region.

6. The system of claim 1, wherein the top surface of the hand member includes a downward slope oriented from the coupling to the wrist member.

7. The system of claim 1, wherein the bottom surface of the hand member is substantially planar.

8. The system of claim 1 further includes a finger member having a top surface and a bottom surface, and wherein the finger member is coupled to the hand member substantially opposite to the wrist member, and wherein the finger member is configured in combination with the buoyancy to cause a decreased water resistance if the finger member is submerged prior to at least one of the hand and wrist member.

9. The system of claim 8, wherein the top surface of the finger member includes a downward slope to the bottom surface.

10. The system of claim 8, wherein the top and bottom surfaces of the finger member substantially join opposite the coupling to the wrist member.

11. The system of claim 8, wherein the bottom surface of the finger member is substantially planar.

12. The system of claim 8, wherein the wrist member includes a height between the top and bottom surfaces ranging from 1⅝ inches and 3 inches.

13. A hand paddle system comprising:

a wrist member having a top surface and a bottom surface, and wherein the wrist member is configured to releasably couple with the palmar surface of a user's scaphoid region;

a hand member having a top surface and a bottom surface, and wherein the hand member is coupled to the wrist member and configured to releasably couple with the palmar surface of the user's metacarpal region;

a finger member having a top surface and a bottom surface, and wherein the finger member is coupled to the hand member substantially opposite to the wrist member, and wherein the length of the top surface is greater than the distance between the distal and proximal phalanges of the user's hand, and wherein the top and bottom surfaces of the finger member substantially join opposite the coupling to the wrist member;

wherein the hand paddle system include a buoyancy with respect to a water surface;

wherein the bottom surfaces of the finger, wrist and hand members are configured in combination with the buoyancy to cause an increased water resistance if at least one of the wrist member and hand member is submerged prior to the finger member; and wherein the bottom surface of the wrist member includes a curved surface having a curvature between 90 and 180 degrees.

14. A method for encouraging optimal muscular coordination and orientation of a user's hand during a swimming stroke including the acts of:

providing a hand paddle comprising a wrist member having a top surface and a bottom surface; a hand member having a top surface and a bottom surface, and wherein the hand member is coupled to the wrist member, and wherein the bottom surface of the wrist member includes a curved surface having a curvature between 90 and 180 degrees;

engaging the palmar surface of a user's scaphoid region with the top surface of the wrist member;

engaging the palmar surface of a user's metacarpal region with the top surface of the hand member;

engaging the palmar surface of the user's fingers with the handle paddle;

causing increased water entry resistance if the user places any portion of the wrist member in the water prior to the hand member or improperly angles their hand and arm; and minimizing water entry resistance if the user places the hand member in the water prior to the wrist member and properly angles their hand and arm.

15. The method of claim 14, wherein the act of engaging the palmar surface of the user's fingers with the handle paddle includes engaging the palmer surface of the user's finger on a top surface of a finger member coupled to the hand member substantially opposite the wrist member.

16. The method of claim 15, wherein the finger member is tapered away from the coupling to the hand member so as to include a substantially narrow tip.

17. The method of claim 15, wherein the act of minimizing water entry resistance if the user places the hand member in the water prior to the hand member includes engaging the substantially narrow top of the finger member with the water surface.

18. The method of claim 14, wherein the act of causing increased water entry resistance if the user places any portion of the wrist member in the water prior to the hand member includes engaging the bottom surface of the wrist member with the water and configuring the bottom surface of the wrist member to include a region substantially orthogonal to the water surface.

19. The method of claim 14, wherein the wrist member includes a height between the top and bottom surfaces ranging from 1⅝ inches and 3 inches.

* * * * *